US007735583B2

(12) United States Patent
Lin

(10) Patent No.: US 7,735,583 B2
(45) Date of Patent: Jun. 15, 2010

(54) ROLLER CONE BIT BEARING WITH ELASTOMERIC SEAL HAVING SELF BREAK-IN PROPERTY AND METHOD

(75) Inventor: Chih Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 148 days.

(21) Appl. No.: 11/944,272

(22) Filed: Nov. 21, 2007

(65) Prior Publication Data

US 2009/0127002 A1 May 21, 2009

(51) Int. Cl.
*E21B 10/00* (2006.01)
*F16C 33/72* (2006.01)

(52) U.S. Cl. ..... 175/371; 384/94; 277/550

(58) Field of Classification Search ..... 175/371; 384/94; 277/500, 549, 550
See application file for complete search history.

(56) References Cited

U.S. PATENT DOCUMENTS

| | | | | |
|---|---|---|---|---|
| 4,204,437 | A | 5/1980 | Espana | |
| 4,627,882 | A | 12/1986 | Soderstrom | |
| 4,756,631 | A | 7/1988 | Jones | |
| 5,015,001 | A | 5/1991 | Jay | |
| 5,092,687 | A | 3/1992 | Hall | |
| 5,201,795 | A | 4/1993 | Howard et al. | |
| 5,433,531 | A | 7/1995 | Thompson | |
| 5,763,956 | A | 6/1998 | Metz et al. | |
| 5,975,223 | A | 11/1999 | Karlsson | |
| 6,431,758 | B1 | 8/2002 | Lyon et al. | |
| 6,513,607 | B2 | 2/2003 | Peterson et al. | |
| 6,637,528 | B2 | 10/2003 | Nishiyama et al. | |
| 7,086,487 | B2 | 8/2006 | Nguyen | |
| 7,168,147 | B2 | 1/2007 | Smith et al. | |
| 7,241,049 | B2 | 7/2007 | Lin et al. | |
| 2006/0249311 | A1 | 11/2006 | Thuresson et al. | |
| 2008/0179103 | A1 * | 7/2008 | Langford et al. | 175/371 |

* cited by examiner

*Primary Examiner*—David J. Bagnell
*Assistant Examiner*—Catherine Loikith
(74) *Attorney, Agent, or Firm*—Bracewell & Giuliani LLP

(57) ABSTRACT

A roller cone bit having an elastomeric seal with a self break-in property is disclosed. The elastomeric seal includes abrasive material on a sliding surface for facilitating break-in. Examples of abrasive materials include ground rock, hard metals, tungsten, tungsten carbide, tantalum, tantalum carbide, titanium carbide, titanium nitride, and minerals, diamonds and nanomaterial enhanced diamond.

23 Claims, 3 Drawing Sheets

ROLLER CONE BIT BEARING WITH ELASTOMERIC SEAL HAVING SELF BREAK-IN PROPERTY AND METHOD

BACKGROUND

1. Field of Invention

This disclosure relates to earth boring rotating cone bits, and particularly to providing a seal having a self break-in property on sliding engagement surfaces of the cone and the mating bearing pin.

2. Description of Prior Art

Drill bits used in drilling of subterranean well bores typically comprise drag bits and roller cone bits. Roller cone bits typically comprise a body having legs extending downward and a head bearing extending from the leg towards the axis of the bit body. Frusto-conically shaped roller cones are rotatably mounted on each of these journals and are included with cutting teeth on the outer surface of these cones. As the bit rotates, the cones rotate to cause the cutting elements to disintegrate the earth formation. Because of the high stresses incurred during drilling operations, the bearing mating surfaces within the bit require a bearing material or a surface treatment to sustain the loads and extend the bit life.

The cylindrical portion of bearing pin and cylindrical cavity of the cone define a journal bearing. Thrust bearing surfaces are located between flat portions of the bearing pin and cone cavity. The bearing spaces between the cone and bearing pin are filled with a lubricant. A pressure compensator equalizes pressure of the lubricant with the hydrostatic pressure on the exterior. Roller cone bits typically include a seal or a seal assembly to seal lubricant within the bearing and keep debris out of the bearing.

During operation of the drill bit the seal assembly experiences sliding contact with the leg or one of its components. Alternatively, some sliding contact may be experienced with respect to the cone. Sliding contact may present a problem when as machined roughness or other effects of machining, are present on a sliding surface. During the early life of the components, the protrusions of the as machined roughness may damage corresponding sliding surfaces before they are worn down by the sliding action. The damage caused by as machined roughness is especially prevalent when the corresponding sliding seal surface comprises a non-metal material such as an elastomer. In some alternative embodiments, the entire seal assembly comprises one or more seals comprised of an elastomeric material. Accordingly a need exists for eliminating potential damage caused by as machined roughness onto elastomeric seals.

SUMMARY OF INVENTION

The disclosure herein provides embodiments of a seal comprised of an elastomeric member having self break-in properties for use in a roller cone bit. Also disclosed herein is an earth-boring bit comprising a bit body, a cantilevered bearing shaft depending from the bit body, a cone mounted for rotation on the bearing shaft, and a seal assembly mounted between the cone and the bearing shaft. The seal assembly comprises an elastomeric body and abrasive particles on a portion of the body. The abrasive particles are contactable with any surface in sliding contact with the seal and are configured to smooth the sliding surface. Smoothing the sliding surface removes protrusions that may damage the elastomeric body.

Also included herein is a method of sealing between a rotating and a static component of a subterranean drilling tool, comprising forming an annular seal from an elastomeric material wherein abrasive particles are on a surface of the seal, forming a seal gland between the rotating component and the static components of the tool, and placing the seal in the seal gland with the surface having the abrasive particles in rotating contact with the static component.

BRIEF DESCRIPTION OF DRAWINGS

Some of the features and benefits of the present invention having been stated, others will become apparent as the description proceeds when taken in conjunction with the accompanying drawings, in which.

Figure 1:
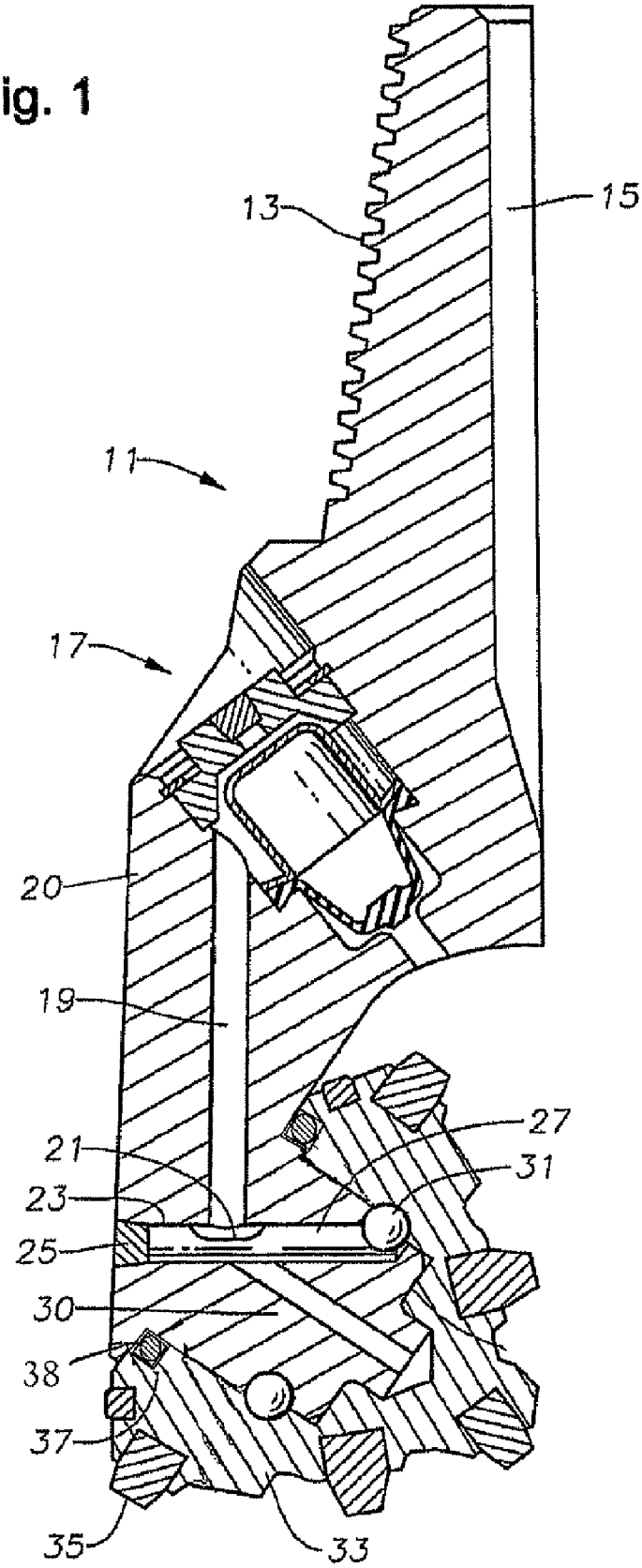
FIG. 1 is a cross-sectional view of a portion of a roller cone bit in accordance with the present disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides in a side cross-sectional view an example of a portion of a roller cone drill bit 11. The drill bit 11 includes a threaded upper portion 13 for connection to a drill string member (not shown). A fluid passage 15 directs drilling fluid to a nozzle (not shown) that impinges drilling fluid or mud against the borehole bottom to flush cuttings to the surface of the earth. A pressure-compensating lubrication system 17 is contained within each section of the body, there usually being three, which are welded together to form the composite body. One example of a suitable lubrication system is shown in U.S. Pat. No. 4,727,942.

A lubricant passage 19, which typically is formed in each body section 20, extends from each compensator 17 downwardly into intersection with another lubricant passage 21 in which a ball plug 23 is secured to the body by a plug weld 25. Lubricant passages 27 carry lubricant to the space between a cylindrical journal bearing surface and a corresponding cylindrical surface of bearing shaft 30. Bearing shaft or pin 30 is cantilevered downwardly and inwardly from an outer and lower region of the body of the bit. The lower region of the body is commonly known as the shirttail. Ball plug 23 retains a series of balls 31 that rotatably secure cone 33 to bearing shaft 30. Cone 33 has a plurality of rows of earth-disintegrating cutting elements 35 that may be constructed of a sintered tungsten carbide and secured by interference fit into mating holes in cone 33. Alternately, cutting elements 35 may be teeth machined in the surface of cone 33.

The roller cone bit 11 includes a seal assembly 37 at the base where the bearing shaft 30 extends from the bit body 20. The seal assembly 37 comprises a seal gland 38 formed into the inner radius of the cone 33. The seal gland 38 is shown as having a rectangular cross section and is formed along the outer radius of the recess in the cone 33 formed to receive the bearing shaft 30. The seal assembly 37 further comprises an elastomeric member 50 disposed into the seal gland 38.

Figure 2:
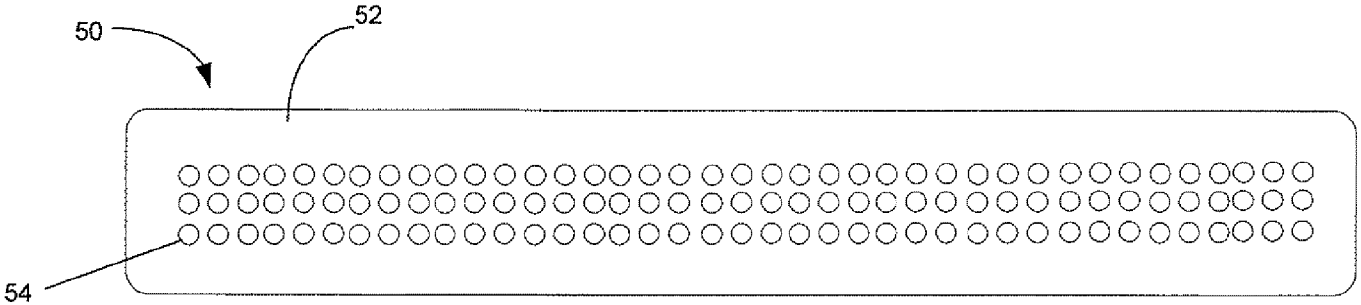
FIG. 2 is a side view of a seal in accordance with the present disclosure.

FIG. 2 illustrates a side view of the elastomeric member 50, where the member 50 comprises a body 52 having particles 54 on its outer surface. In one embodiment, the body 52 has a generally annular configuration formed to provide a sealing function in a space between the cone 33 and the bearing shaft 30. Examples of the material used in making the body 52 include thermosetting polymer materials such as nitrile butandiene rubber (NBR), hydrogenated nitrile butandiene rubber (HNBR), fluorinated elastomer like Dupont's Viton, Daikin Chemical's Dai-E1, 3M Dyneon's Fluorel, and Solvay-Solexis' Technoflon), and perfoluoroelastomer. Thermoplastic materials such as fluoroplastic or polyetheretherketone (PEEK) can also be used as the seal material. In the embodiment shown, the particles 54 comprise an abrasive material. Examples of an abrasive material include hard metal particles, such as tungsten carbide, tantalum carbide, titanium carbide, titanium nitride, and combinations thereof. Other examples include minerals, such as diamonds, nanomaterial enhanced diamond, and combinations thereof. Naturally occurring abrasives may be used such as ground rock, calcite (calcium carbonate), emery (impure corundum), diamond dust, novaculite, pumice dust, rouge (hematite), sand, and combinations thereof. Synthetic abrasives for use include borazon, ceramic, corundum, glass powder, silicon carbide, tungsten carbide, zirconia, alumina, and combinations thereof. In one embodiment, the size of the particles is not substantially larger than the roughness of the surface.

Figure 3:
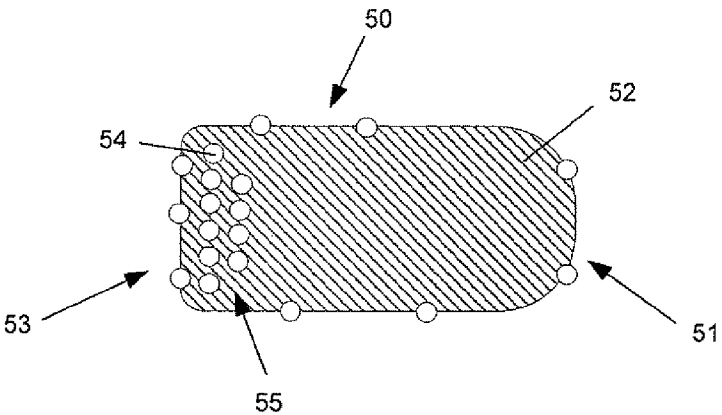
FIG. 3 is a cross sectional view of a seal in accordance with the present disclosure.

A cutaway view of the elastomeric member 50 is provided in FIG. 3. In this view, the end having the particles 54 is referred to herein as the sliding surface 53. The opposite end, illustrated as having a generally curved shape, is referred to herein as the static surface 51. It should be pointed out however that the particles 54 can be disposed on any side of the body 52 (i.e. top, bottom, or a lateral side) and are not limited to a specific surface. Moreover, the particles 54 are not limited to the organized formation provided in the figures, but may be randomly applied on the elastomeric member 50. As shown in FIGS. 2 and 3, the particles 54 may be disposed at the surface of the body 52, and may also be embedded beneath the body surface and may comprise multiple layers 55 on and beneath the surface. One method of applying the abrasive to the member 50 comprises mixing the abrasive with a carrier in a paste form, then evaporating the carrier during a molding process. Alternatively, the abrasive can be premixed in a strip of seal material of the same compound as the seal body and fused together with the seal body in the molding. Another method comprises applying abrasive on a transfer tape and applying the tape on the surface of the mold corresponding to the inner diameter of the seal. In yet another embodiment, the abrasive can be mixed in a lubricant and applied to the seal gland machined surface prior to assembly. Applying the same on the seal inner diameter prior to assembly is possible.

For the purposes of the present disclosure, the phrase abrasive particles on the seal includes particles embedded, impregnated, glued, or otherwise attached to a seal surface such that at least a portion of the particle extends out from the seal itself. Optionally, the phrase on the seal includes particles on or elevated just above a seal surface, wherein the particles are not affixed to the seal; one example is where the particles are in a viscous fluid, such as a lubricant, and applied to a seal surface.

Figure 4:
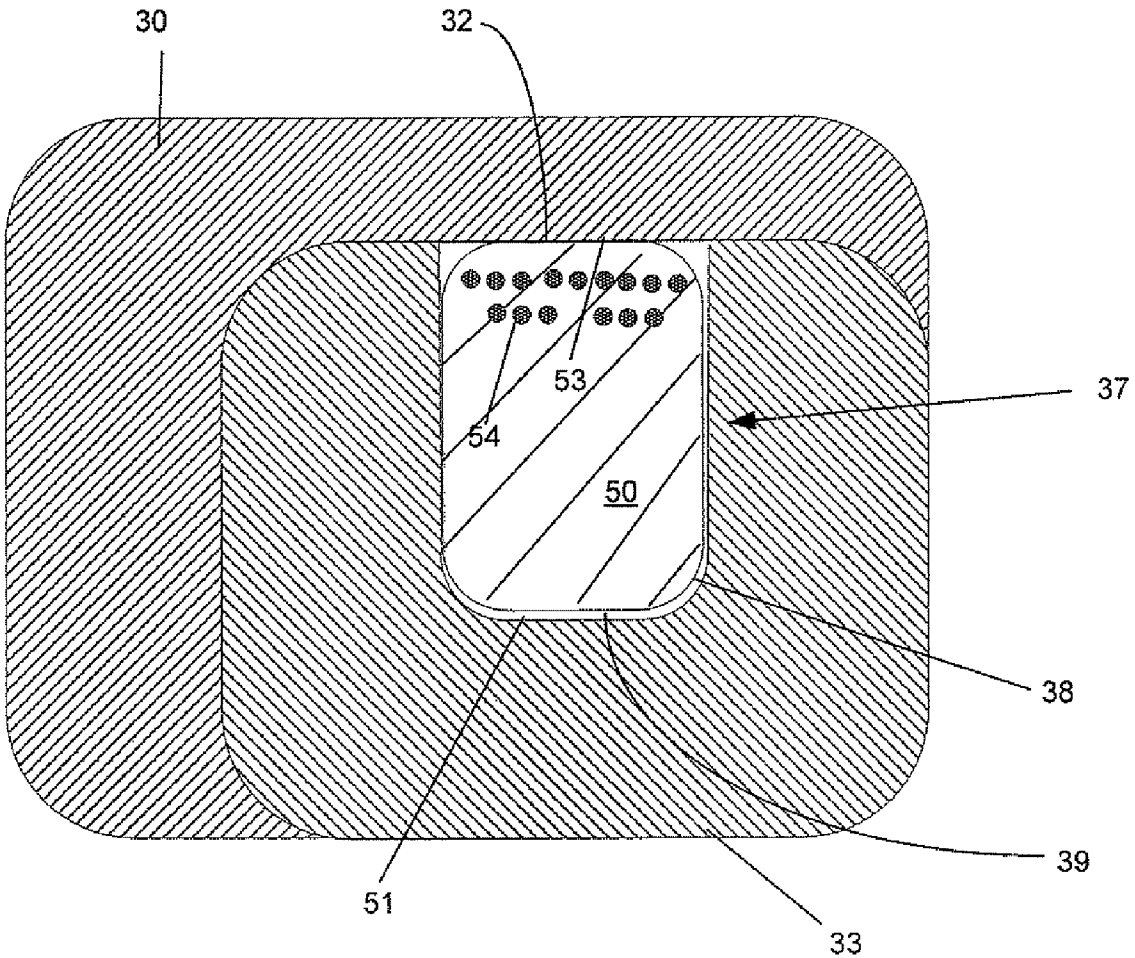
FIG. 4 is a cross sectional view of roller cone bit in accordance with the present disclosure.

An enlarged view of the seal assembly 37 having the seal of the present disclosure is shown in a cutaway view in FIG. 4. In this embodiment, the elastomeric member 50 is disposed within the seal gland 38 formed in the roller cone 33 having its static surface 51 seated against the bottom surface 39 of the gland 38. Conversely, the sliding surface 53 of the elastomeric member 50 is in contact with a corresponding sliding surface 32 on the bearing shaft 30. During operation when the roller cone 33 rotates about the bearing shaft 30, the corresponding sliding surface 32 is the region of the bearing shaft 30 in sliding contact with the member sliding surface 53. Thus the corresponding sliding surface 32 will also be subjected to sliding contact of the abrasive particles 54. As such. during initial use (or break-in) of the roller cone disclosed herein, any grooves, ridges, peaks. or other undulations present on the corresponding sliding surface 32, such as from machining, may be conditioned or eroded away by the sliding action of the abrasive particles 54 on the sliding surface 53 of the member 50. It should be pointed out that any outer surface of the member 50 may include abrasive particles thereon. The action of the abrasive particles 54, which eliminates the damaging surface imperfections, provides a smooth surface that will not damage or otherwise reduce the life of a roller cone seal.

The invention claimed is:

1. An earth-boring bit, comprising:

a bit body;

a cantilevered bearing shaft depending from the bit body;

a cone mounted for rotation on the bearing shaft; and a seal assembly mounted between the cone and the bearing shaft, the seal assembly having an elastomeric body and abrasive particles provided on a portion of the elastomeric body, so that when the earth boring bit is initially used and the cone rotates with respect to the bearing shaft, the abrasive particles contact and condition a portion of the cone.

2. The bit according to claim 1, further comprising a bearing seal gland on the bearing shaft formed to receive the elastomeric body therein.

3. The bit according to claim 1, wherein the elastomeric body comprises material selected from the group consisting of vulcanized rubber, thermosetting polymer materials, nitrile butandiene rubber (NBR), hydrogenated nitrile butandiene rubber (HNBR), fluorinated elastomer, perfluoro-elastomer, thermoplastic materials, fluoroplastic, polyetheretherketone, and combinations thereof.

4. The bit according to claim 1, wherein the abrasive particles comprise materials selected from the group consisting of ground rock, hard metals, boron carbide, tungsten carbide, tantalum carbide, titanium carbide, titanium nitride, minerals, diamonds, nanomaterial enhanced diamond, calcite, emery, diamond dust, novaculite, pumice dust, hematite, sand, borazon, ceramic, corundum, glass powder, silicon carbide, zirconia, alumina, and combinations thereof.

5. The bit according to claim 1, wherein the abrasive particles are positioned on the body for sliding contact against the bearing shaft.

6. The bit according to claim 5, wherein the sliding contact of the abrasive particles against the bearing shaft smoothes the bearing shaft surface.

7. The bit according to claim 1, wherein the elastomeric member has a generally annular form and wherein abrasive particles are disposed on all outer surfaces of the member.

8. The bit according to claim 1, wherein the particles are embedded in the elastomeric member.

9. The bit according to claim 1, wherein the particles are embedded in layers in the elastomeric member.

10. The bit according to claim 1, wherein the particles are formed a synthetic material.

11. A method of sealing between a rotating and a static component of a subterranean drilling tool, comprising:

(a) forming an annular seal from an elastomeric material wherein abrasive particles are on a surface of the seal;

(b) forming a seal gland using the annular seal and disposing the seal gland between the rotating component and the static components of the tool so that the abrasive particles are contactable with the rotating component; and (c) conditioning a sliding surface on the rotating component by the rotating component with respect to the static component so that the abrasive particles contact the rotating component.

12. The method of claim 11, wherein the abrasive particles comprise material selected from the group consisting of ground rock, hard metals, boron carbide, tungsten carbide, tantalum carbide, titanium carbide, titanium nitride, minerals, diamonds, nanomaterial enhanced diamond, calcite, emery, diamond dust, novaculite, pumice dust, hematite, sand, borazon, ceramic, corundum, glass powder, silicon carbide, zirconia, alumina, and combinations thereof.

13. The method of claim 11, wherein the elastomeric material comprises material selected from the group consisting of vulcanized rubber, thermosetting polymer materials, nitrile butandiene rubber (NBR), hydrogenated nitrile butandiene rubber (HNBR), fluorinated elastomer, perfluoro-elastomer, thermoplastic materials, fluoroplastic, polyetheretherketone, and combinations thereof.

14. The method of claim 11, further comprising breaking in the seal by rotating the rotating component thereby providing sliding contact between the abrasive material and the corresponding surface of the static component.

15. The method of claim 14, wherein the step of breaking in the seal smoothes the corresponding surface of the static component.

16. The method of claim 11, wherein the rotating component comprises a roller cone.

17. The method of claim 11, wherein the static component comprises a bearing shaft.

18. The method of claim 11, wherein the seal has a generally annular configuration and abrasive particles are on all exterior surfaces of the seal.

19. The method of claim 11, wherein the step of forming the seal further comprising incorporating the abrasive particles on the seal comprising mixing the abrasive with a carrier in a paste form, combining the paste with the seal raw materials in a mold, and forming the seal in the mold.

20. The method of claim 11, wherein the step of forming the seal further comprising incorporating the abrasive particles on the seal comprising mixing abrasive with elastomeric material to form a strip and fusing together the strip with the seal.

21. The method of claim 11, wherein the step of forming the seal further comprising incorporating the abrasive particles on the seal comprising applying abrasive on a transfer tape, disposing the tape in a seal mold, and molding the seal, wherein the tape is disposed on a surface of the mold corresponding to the inner diameter of the seal.

22. The method of claim 11, wherein the step of forming the seal further comprising incorporating the abrasive particles on the seal comprising mixing abrasive in a lubricant to form a mixture, applying the mixture to a seal gland machined surface and or applying the mixture on the seal inner diameter.

23. The method of claim 11, further comprising assembling the drilling tool.

* * * * *

UNITED STATES PATENT AND TRADEMARK OFFICE

CERTIFICATE OF CORRECTION

PATENT NO. : 7,735,583 B2
APPLICATION NO. : 11/944272
DATED : June 15, 2010
INVENTOR(S) : Chih Lin It is certified that error appears in the above-identified patent and that said Letters Patent is hereby corrected as shown below:

Column 5, line 16, insert -- as -- before "a synthetic"
Column 5, line 28, insert -- rotating -- before "the rotating"
Column 6, line 19, delete "comprising" and insert -- comprises --
Column 6, line 20, delete "comprising" and insert -- by --
Column 6, line 20, insert -- particles -- before "with a"
Column 6, line 24, delete "comprising" and insert -- comprises --
Column 6, line 25, delete "comprising" and insert -- by --
Column 6, line 25, insert -- the -- before "abrasive"
Column 6, line 25, insert -- particles -- before "with elasto-"
Column 6, line 29, delete "comprising" and insert -- comprises --
Column 6, line 30, delete "comprising" and insert -- by --
Column 6, line 30, insert -- the -- before "abrasive"
Column 6, line 30, insert -- particles -- before "on a transfer"
Column 6, line 35, delete "comprising" and insert -- comprises --
Column 6, line 36, delete "comprising" and insert -- by --
Column 6, line 36, insert -- the -- before "abrasive"
Column 6, line 36, insert -- particles -- before "in a lubricant"

Signed and Sealed this

Thirtieth Day of November, 2010

David J. Kappos

David J. Kappos
*Director of the United States Patent and Trademark Office*